US006540549B2

(12) United States Patent
Rupert

(10) Patent No.: US 6,540,549 B2
(45) Date of Patent: Apr. 1, 2003

(54) KEYED POWER CORD

(75) Inventor: Brian K. Rupert, Fort Wayne, IN (US)

(73) Assignee: Dekko Engineering, Inc., Kendallville, IN (US)

( * ) Notice: Subject to any disclaimer, the term of this patent is extended or adjusted under 35 U.S.C. 154(b) by 0 days.

(21) Appl. No.: 09/881,467

(22) Filed: Jun. 14, 2001

(65) Prior Publication Data

US 2002/0193000 A1 Dec. 19, 2002

(51) Int. Cl.[7] ..... H01R 11/00; H01R 13/64; H01R 4/60

(52) U.S. Cl. ..... 439/502; 439/680; 439/215

(58) Field of Search ..... 439/215, 211, 439/502, 505, 680, 214

(56) References Cited

U.S. PATENT DOCUMENTS

| | | | | |
|---|---|---|---|---|
| 3,652,976 A | | 3/1972 | Tymkewicz | |
| 3,742,424 A | | 6/1973 | Startin | |
| 4,386,820 A | | 6/1983 | Dola et al. | |
| 4,775,802 A | | 10/1988 | Dods | 307/147 |
| 5,234,360 A | | 8/1993 | Kramer, Jr. | 439/505 |
| 5,816,849 A | | 10/1998 | Schmidt | 439/505 |
| 5,967,820 A | | 10/1999 | Siegal et al. | 439/214 |
| 6,036,533 A | | 3/2000 | Huang | 439/502 |
| 6,123,562 A | * | 9/2000 | King et al. | 439/211 |
| 6,139,360 A | | 10/2000 | Hayashi et al. | 439/502 |

* cited by examiner

*Primary Examiner*—Tulsidas Patel
*Assistant Examiner*—Chandrika Prasad
(74) *Attorney, Agent, or Firm*—Taylor & Aust, P.C.

(57) ABSTRACT

An electrical power distribution system for supplying electrical energy to power utilization equipment located, for example, at multiple work stations in a modular furniture installation, has a plurality of power taps, each having an electrical inlet connector, an electrical outlet connector and a power lead for connection to the power utilization equipment. Some of the inlet and outlet connectors are configured differently from others. A plurality of power transmitting jumpers, each having an electrical connector at each of the opposite ends thereof interconnect the outlet connector of one power tap and the inlet connector of another power tap. Certain ones of the jumper electrical connectors are configured differently from other of the jumper electrical connectors so as to connect to only selected ones of the power tap connectors. The differing configurations necessitate interconnection of the power taps in a prescribed order and the number of different configurations effectively limits the maximum number of power taps that can be chained together. A power supply jumper having a power supply plug at one end for receiving electrical energy from a source and a universally configured electrical connector at the opposite end may connect to any one of the power tap inlet connectors to supply power to that and all subsequent power taps.

19 Claims, 5 Drawing Sheets

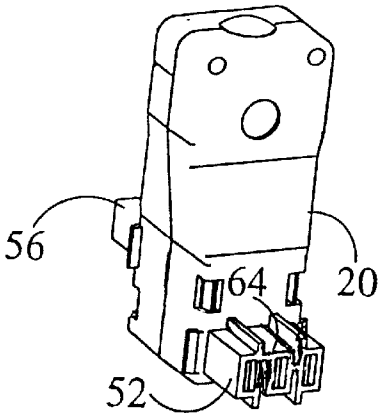
Fig. 5a
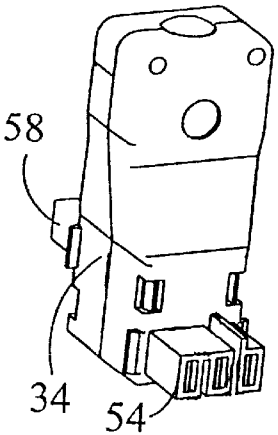
Fig. 5b
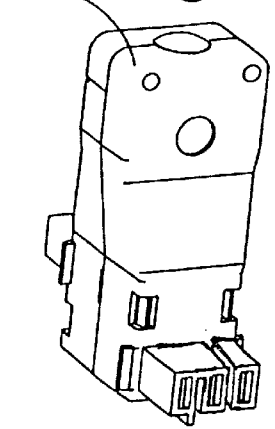
Fig. 5c
Fig. 5d
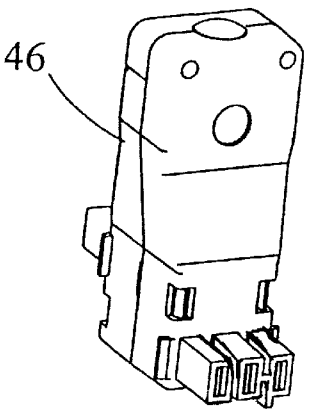
Fig. 5e
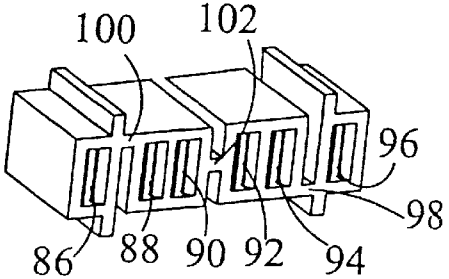
Fig. 6

KEYED POWER CORD

BACKGROUND OF THE INVENTION

1. Field of the Invention

The present invention relates to power distribution systems and more particularly to a power distribution system for supplying power to a plurality of spaced apart work stations as typically found in modular furniture environments.

2. Description of the Related Art

Desk tops, modular tables and similar modular furniture installations frequently employ modular power distribution systems having electrical segments which simply plug together and can be easily rearranged each time the modular furniture arrangement is modified rather than requiring the services of an electrician. One simple form of such a wiring system has a plurality of work stations each coupled to an adjacent one by a pluggable jumper. One of the work stations is plugged to a source of electrical energy and the remaining ones receive power sequentially from an adjacent one by way of the jumpers. This form may employ only one circuit having conventional hot, neutral and ground wires. The unlimited chaining together of such work stations may violate electrical wiring codes.

SUMMARY OF THE INVENTION

The present invention provides an electrical power distribution system well suited to sequentially connecting a plurality of work stations which imposes a limit on the number and/or the sequence in which the work stations are concatenated.

The invention comprises, in one form thereof, an electrical power distribution system for supplying electrical energy from a source to at least two power utilization devices and includes a power tap having a power lead for connection to a first power utilization device, two pair of matable connectors, each pair having one or more portions which preclude mating between either connector from one pair and a connector from the other pair. One connector pair supplies electrical energy from the source by way of the power lead to the first power utilization device and the other connector pair supplies electrical energy from the power tap to a second power utilization device. Each pair of matable connectors includes a pattern of interengaging segments and recesses with the pair pattern for one pair differing from the pair pattern for the other pair.

Also in general, and in one form of the invention, an electrical power distribution system for supplying electrical energy to at least two power utilization devices has at least two power taps, each having an electrical inlet connector, an electrical outlet connector and a power lead for connection to power utilization equipment. The two inlet connectors are configured differently from one another. A power transmitting jumper has an electrical connector at each of the opposite ends thereof for interconnecting the outlet connector of the first power tap to the inlet connector of the second power tap. One of the jumper electrical connectors is configured to connect to the inlet connector of the second power tap, but not to the first power tap, and the other jumper electrical connector configured to connect to the outlet of the first power tap, but not to the second power tap. A power supply jumper has a power plug electrical connector at one end for receiving electrical energy from a source and another universally configured connector adapted to connect to either one of the power tap inlet connectors at the other end.

An advantage of the present invention is that an unskilled workman can not violate electrical wiring code provisions and/or create an unsafe condition by concatenating an excessive number of work stations.

Another advantage is that the maximum number of work stations that can receive power from a single source is limited.

A further advantage is that the sequence in which a number of work stations can be chained together by interconnecting jumpers is strictly determined by keyed work station and jumper connector configurations.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIGS. 5*a*–5*e* illustrate perspective views of the five power taps showing various inlet connector web configurations; and FIG. 6 is a perspective view of a power tap inlet connector adapted to multi-circuit applications.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
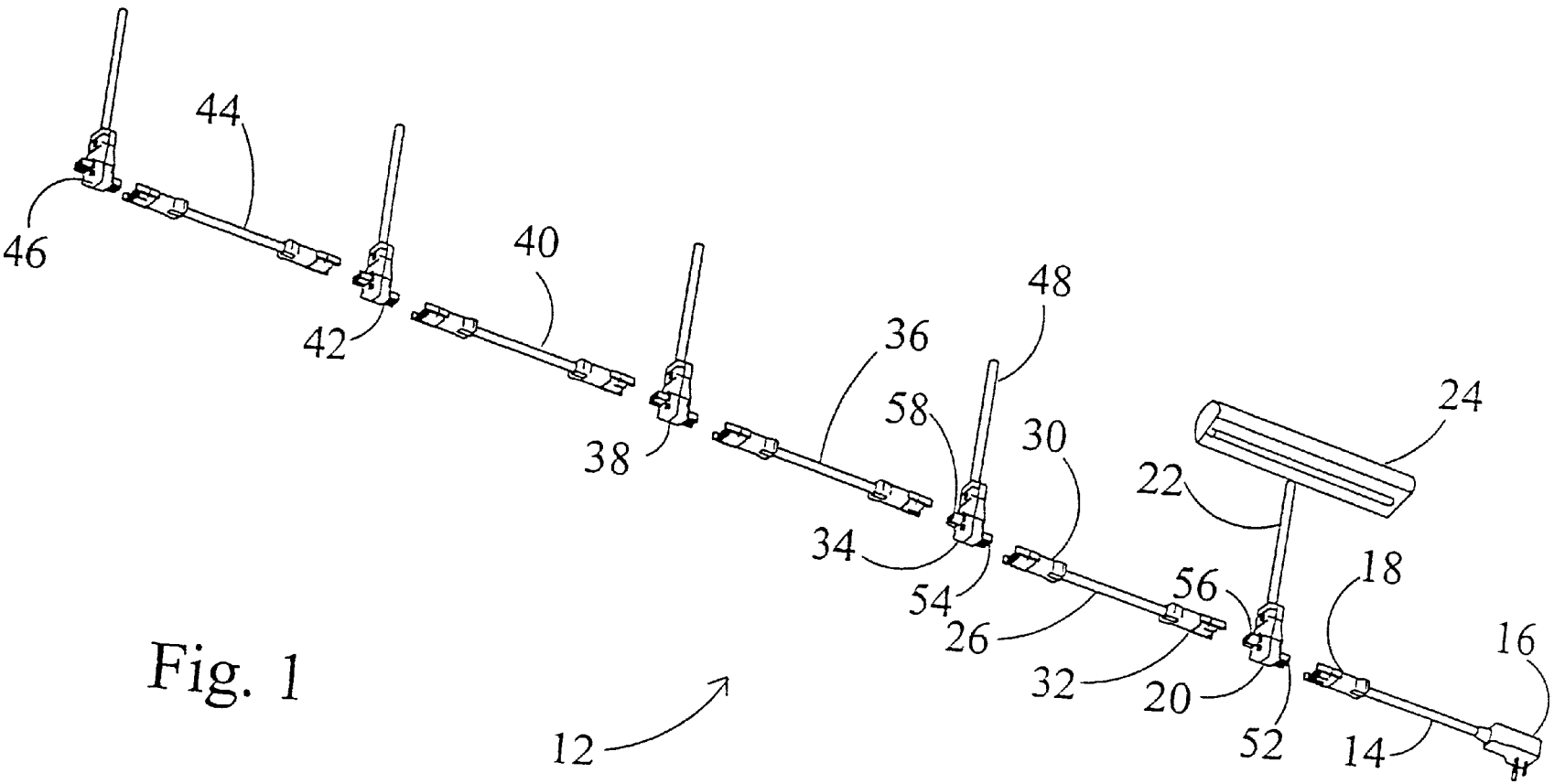
FIG. 1 is a perspective view of an electrical power distribution system according to the invention in one form.

Referring now to the drawings and particularly to FIG. 1, there is shown a power distribution system 12 having a power supply jumper 14 which may be connected to a source of electrical energy by a fused power cord plug 16. The jumper 14 has a connector 18 at the opposite end thereof for connection to a connector 52 of the power tap or "T" 20. The power tap supplies energy to a load or utilization device (illustrated as the fluorescent lamp 24) by way of the power tap power lead 22. Of course, a typical work station will have lights and electrical outlets for a computer, printer or other equipment. Jumper 26 connects to the outlet connector 56 of the power tap 20 and supplies power to inlet connector 54 of a similar power tap 34. Power tap 34 has a power tap power lead 48 for supplying one or more devices at that location and an outlet connector 58 to which a further jumper 36 may be connected to power the power tap 38. Additional jumpers 40 and 44 supply similar power taps 42 and 46. Connectors 32 and 56 have a matching keying arrangement which allows those two connectors to be mated, but connector 32 can not mate with any of the other power tap inlet or outlet connectors. Similarly, connectors 30 and 54 have a matching keying arrangement which allows those two connectors to be mated, but connector 30 can not mate with any of the other power tap inlet or outlet connectors. All the other connectors associated with jumpers 36, 40 and 44 and the power taps 38, 42 and 46 have analogous keying arrangements. Patterns of interconnectable webs or ribs and corresponding slots illustrate one of the many possible keying techniques.

Figure 2:
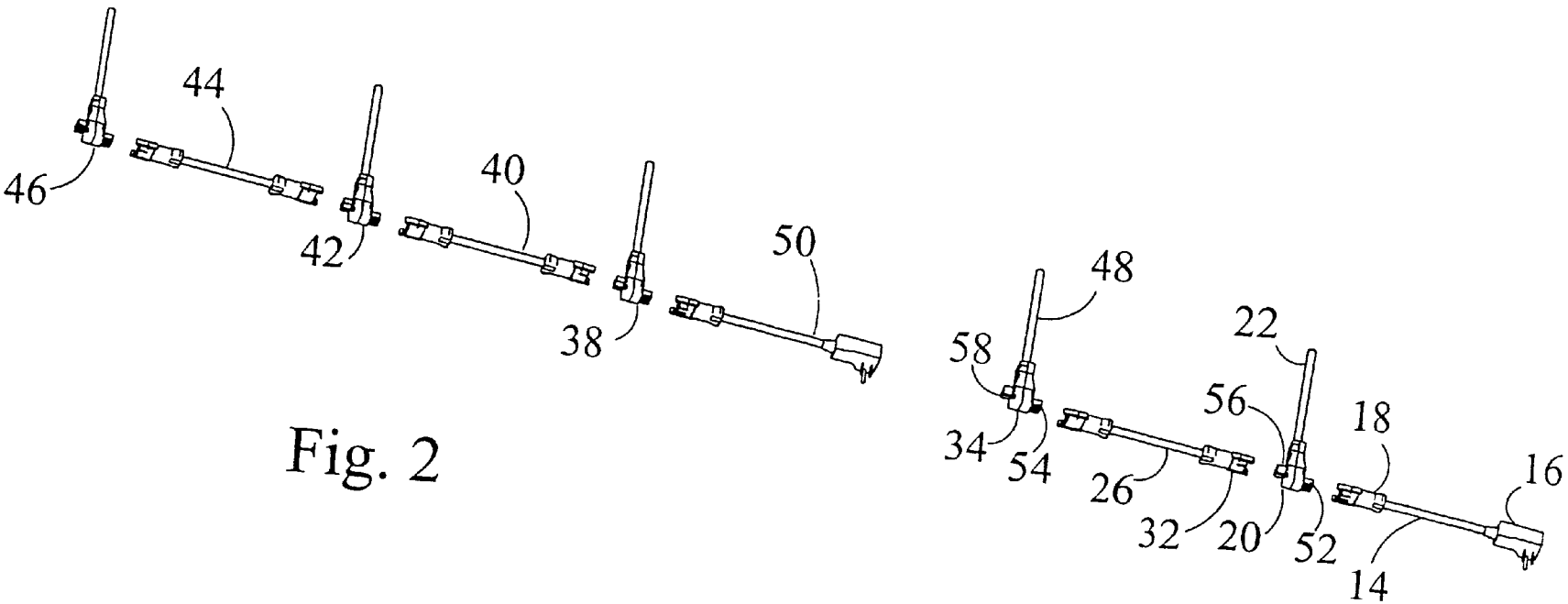
FIG. 2 is a perspective view of an electrical power distribution system illustrating a variation of FIG. 1.

The power distribution system of FIG. 1 may be split to connect to two different circuits by employing a second power supply jumper 50 as shown in FIG. 2. As in FIG. 1, a power tap 20 has a power lead 22 for connection to a first power utilization device 24. There are two pair of matable connectors 18 and 52, and 32 and 56 with each pair having at least one portion which precludes mating between either connector from one pair and a connector from the other pair. One connector pair 18 and 52 supplies electrical energy from the source by way of the power lead 14 to the first power utilization device 24 and the other connector pair 56 and 32 supplies electrical energy from the power tap 20 to a second power utilization device by way of jumper 26, connector pair 30, 54, power tap 34 and power lead 48. Each pair of matable connectors includes a pattern of interengaging segments or webs and recesses and the pair pattern for one pair differs from the pair pattern for the other pair. A second power tap 34 has a power lead 48 for connection to a second power utilization device and a third pair of matable connectors 30 and 54 with one of the third pair receiving power from said other connector pair 32, 56 and the other of the third pair supplying electrical energy by way of the power tap power lead 48 to the second power utilization device. The third pair of matable connectors includes a pattern of interengaging segments and recesses differing from both the other connector pair patterns, but connector 18 of connector pair 18, 52 can be mated with connector 54 of the third pair of matable connectors 30, 54, or with any of the other power tap inlet connectors. For example, a power supply jumper 50 which is configured the same as power supply jumper 14 is shown in FIG. 2 ready to connect to the power tap 38 and to supply energy to the remaining three taps. If the maximum number of permissible power taps in a single circuit is eight, the right hand chain can be extended to a maximum of eight power taps while the left hand chain can only be expanded to a maximum of five since the "T's" 20 and 34 are not present. Thus, two separate circuits may be established by the use of two power supply jumpers 14 and 50 as shown in FIG. 2. More than one circuit may also be established as shown in FIG. 6.

Figure 3:
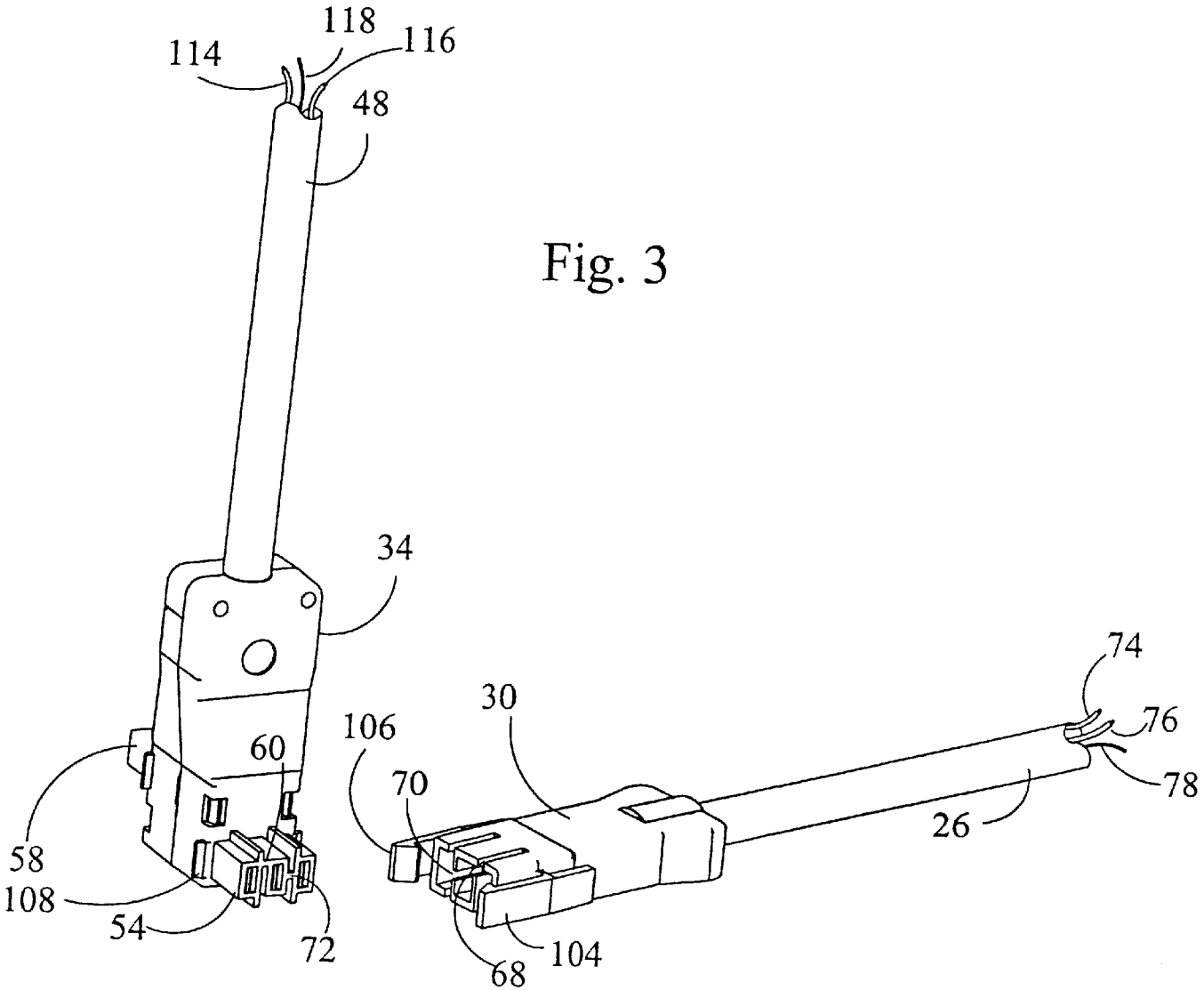
FIG. 3 is a perspective view of one power tap and a portion of a power transmitting jumper from FIG. 1.

FIG. 3 illustrates one possible keying arrangement for connectors 30 and 54 employing a set of intermeshable key segments or webs and recesses or grooves such as webs 60 and 72, and slots 68 and 70. Connector 54 has three contact recesses in which three electrical contacts are housed and the connector 30 has three corresponding recessed contacts for electrical connection thereto. One set of contacts connect to hot 74, neutral 76 and ground 78 conductors and the other set of contacts connect to hot 114, neutral 116 and ground 118 conductors respectively. The contacts may be any of several conventional designs, such as the well known folded sheet metal receptacle and mating blade or prong. The conductors and contacts are insulated by conventional molding techniques. When the connectors 30 and 54 are slid together, segment or web 60 enters the slot or groove 70 and web 72 enters the slot 68 allowing the retaining ears 104 and 106 to snap into grooves such as 108 locking the connectors together. Comparing FIGS. 3 and 4, an attempt to mate connectors 52 and 30 fails because, while web 64 could slide into slot 70, web 62 does not align with the slot 68. This misalignment precludes mating between connectors 30 and 52.

FIGS. 5*a*–5*e* illustrate another embodiment of suitable web locations for a unique keying arrangement. Two columns each including three possible web locations, but with no or only a single web actually present in each column are employed. For each of the three choices for the web location in the first column, there are three possible locations for the web location in the second column yielding nine possible unique patterns. A NEMA electrical code requirement is that there be no more than eight work stations being supplied from a single power supply jumper such as 14. One web configuration is forbidden. A manufacturer simply fails to ever supply a power tap with a particular one of the nine possible configurations and the system is thereby limited to no more than eight stations. Other combinatorial schemes may, of course, be employed. The technique of ribs and grooves is advantageous in that basically the same two molds may be employed to form all of the connectors depicted in FIGS. 5*a*–5*e* and their corresponding jumper connectors by the simple insertion or removal of small inserts in appropriate positions in the respective molds.

Figure 4:
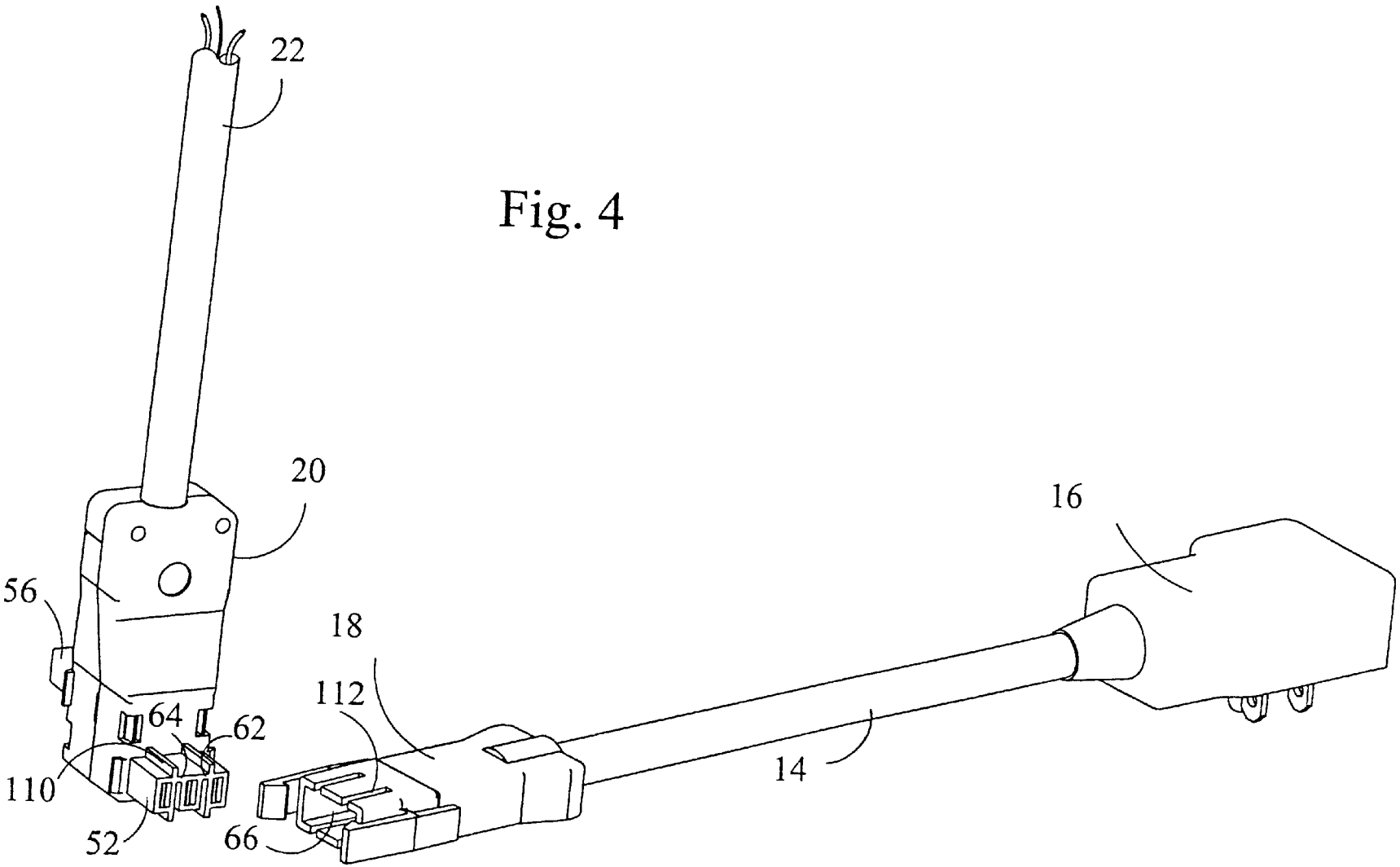
FIG. 4 is a perspective view of one power tap and the power supply jumper of FIG. 1.

Power supply jumper 14 is unique in having a universal connector 18 which can connect to any of the input connectors of FIGS. 5*a*–5*e*. In FIG. 4, connector 18 has a large recess 66 which will receive ribs in any of the nine possible locations. It is, of course, possible to form a universal connector having six individual slots rather than the one large recess shown.

In FIG. 2, connection to two separate circuits was achieved by forming two separate chains. FIG. 6 illustrates another way to establish two circuits. Cables having six conductors comprising two independent hot, neutral and ground circuits may be connected to six corresponding contacts within contact recesses 86, 88, 90, 92, 94 and 96. The connector of FIG. 6 adds a third column of potential keying segments. The connector shown has a rib 100 in the uppermost position of the first column, rib 102 in the middle position of the second column and rib 98 in the lowermost position of the third column. With this keying configuration, there would be twenty seven possible configurations, but only sixteen would be used to again limit the maximum number of work stations on a single circuit to eight. The other eleven rib configurations would not be used.

Provision needs to be made to insure proper polarity, that is, to insure that a connector such as 30 is not simply turned over and then coupled to connector 54. Such reversal would connect the hot input wire 74 to either the neutral 116 or the ground 118 depending on the connector configuration. This may be accomplished in some situations using the rib configurations. It may also be accomplished by additional alignment apertures and pins, asymmetric shaping of the connector mating portions, varying the size or symmetry of the contact recesses, or by a host of other techniques. One simple technique is to omit one of the connector external fins such as 110 and its corresponding slot 112 in the mating connector. This omission imparts the required lack of symmetry. If this omission is done to all the power tap inlet connectors and all of the mating connectors such as 18 and 30, no polarity reversal can occur.

Connection of the universal connector 18 to any of the power tap outlets such as 56 or 58 should also be prevented. Otherwise, a second power supply jumper such as 50 of FIG. 2, might accidentally be connected to an outlet connector at the same time the power supply jumper 14 was connected to an inlet connector. If both were connected to an electrical source, it could defeat the function of the fuse in plug 16 and, if of the wrong polarity, could cause catastrophic results. Omission of an outlet connector external fin which is located differently from the fin, such as 110 which is omitted on the inlet connector, and omission of the corresponding slot on each outlet jumper connector will insure that the jumpers must always be connected outlet to outlet and inlet to inlet. The omission can not be, for example, the upper left fin on both the inlet and outlet sides of the power tap. With this arrangement, the groove pattern of both ends of a jumper may be the same while the web pattern of the inlet connector of each power tap is configured differently from the corresponding outlet connector of that same power tap and insures that each power tap connector includes at least one web which precludes connection to all but one jumper electrical connector configuration. Numerous other keying techniques for coupling configurations which maintain a common electrical polarity among the utilization equipment and insure only a limited number of power taps can connect to one power plug may be employed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical power distribution system for supplying electrical energy to power utilization equipment, comprising:

a plurality of power taps, each having an electrical inlet connector, an electrical outlet connector and a power lead for connection to power utilization equipment, certain ones of the inlet and outlet connectors configured differently from other of the inlet and outlet connectors;

a plurality of power transmitting jumpers, each having a pair of electrical connectors, one at each of the opposite ends thereof, for interconnecting the outlet connector of one power tap to the inlet connector of another power tap, certain ones of the jumper electrical connectors configured differently from other of the jumper electrical connectors to connect to only selected ones of the power tap connectors; and a power supply jumper having an electrical connector at each of the opposite ends thereof, one electrical connector comprising a power plug for receiving electrical energy from a source, and the other electrical connector comprising a universally configured connector adapted to connect to any one of the power tap inlet connectors.

2. The electrical power distribution system of claim 1, wherein the inlet connector of each power tap is configured differently from the corresponding outlet connector of that same power tap.

3. An electrical power distribution system for supplying electrical energy to power utilization equipment, comprising:

a plurality of power taps, each having an electrical inlet connector, an electrical outlet connector and a power lead for connection to power utilization equipment, certain ones of the inlet and outlet connectors configured differently from other of the inlet and outlet connectors; and a plurality of power transmitting jumpers, each having a pair of electrical connectors, one at each of the opposite ends thereof, for interconnecting the outlet connector of one power tap to the inlet connector of another power tap, certain ones of the jumper electrical connectors configured differently from other of the jumper electrical connectors to connect to only selected ones of the power tap connectors;

wherein the differing connector configurations comprise patterns of webs and grooves.

4. The electrical power distribution system of claim 3, wherein the power tap connectors include various web patterns and the jumper connectors include various groove patterns.

5. The electrical power distribution system of claim 4, wherein each power tap connector includes at least one web which precludes connection to all but one jumper electrical connector.

6. The electrical power distribution system of claim 4, further comprising a power supply jumper having an electrical connector at each of the opposite ends thereof, one electrical connector comprising a power plug for receiving electrical energy from a source, and the other electrical connector comprising a universally configured connector adapted to connect to any one of the power tap inlet connectors and including a slot for each said at least one web.

7. The electrical power distribution system of claim 4, wherein each power tap connector includes a coupling configuration for maintaining a common electrical polarity among the utilization equipment.

8. The electrical power distribution system of claim 1, wherein the power utilization equipment is distributed among a plurality of work stations and there is one power tap for each of the plurality of work stations for supplying electrical energy thereto.

9. The electrical power distribution system of claim 4, wherein the differing connector configurations comprise patterns of webs and grooves, the number of possible pattern variations limiting the number of possible connected power taps.

10. The electrical power distribution system of claim 9, wherein there are nine possible pattern variations, one of which is forbidden, thereby limiting the number of possible connected power taps to eight.

11. An electrical power distribution system for supplying electrical energy to at least two power utilization devices, comprising:

first and second power taps, each having an electrical inlet connector, an electrical outlet connector and a power lead for connection to a power utilization device, the two inlet connectors configured differently from one another;

a power transmitting jumper having a pair of electrical connectors, one at each of the opposite ends thereof, for interconnecting the outlet connector of the first power tap to the inlet connector of the second power tap, one of the jumper electrical connectors configured to connect to the inlet connector of the second power tap, but not to the first power tap, and the other jumper electrical connector configured to connect to the outlet of the first power tap, but not to the second power tap; and a power supply jumper having an electrical connector at each of the opposite ends thereof, one electrical connector comprising a power plug for receiving electrical energy from a source, and the other electrical connector comprising a universally configured connector adapted to connect to either one of the power tap inlet connectors.

12. The electrical power distribution system of claim 11, wherein the inlet connector of each power tap is configured differently from the corresponding outlet connector of that same power tap.

13. The electrical power distribution system of claim 11, wherein the differing connector configurations comprise patterns of webs and grooves.

14. The electrical power distribution system of claim 13, wherein the power tap connectors include various web patterns and the jumper connectors include various groove patterns.

15. The electrical power distribution system of claim 13, wherein each power tap connector includes a coupling configuration for maintaining a common electrical polarity among the utilization equipment.

16. An electrical power distribution system for supplying electrical energy from a source to at least two power utilization devices, comprising:

a power tap having a power lead for connection to a first power utilization device; two pair of matable connectors, each pair having a portion which precludes mating between either connector from one pair and a connector from the other pair, one connector pair for supplying electrical energy from the source by way of the power lead to the first power utilization device, and the other connector pair for supplying electrical energy from the power tap to a second power utilization device; and a power supply jumper having an electrical connector at each of the opposite ends thereof, one electrical connector comprising a power plug for receiving electrical energy from a source, and the other electrical connector comprising a universally configured connector adapted to connect to the power tap.

17. The electrical power distribution system of claim 16, wherein each pair of matable connectors includes a pattern of interengagable segments and recesses, the pair pattern for one pair differing from the pair pattern for the other pair.

18. The electrical power distribution system of claim 17, further comprising a second power tap having a power lead for connection to a second power utilization device and a third pair of matable connectors, one of the third pair for receiving power from said other connector pair and the other for supplying electrical energy by way of the power tap and power lead to the second power utilization device, the third pair of matable connectors including a pattern of interengagable segments and recesses differing from both the other connector pair patterns.

19. The electrical power distribution system of claim 18, wherein one of said one connector pair can be mated with one of said third pair of matable connectors.

* * * * *

UNITED STATES PATENT AND TRADEMARK OFFICE

CERTIFICATE OF CORRECTION

PATENT NO. : 6,540,549 B2
DATED : April 1, 2003
INVENTOR(S) : Rupert

It is certified that error appears in the above-identified patent and that said Letters Patent is hereby corrected as shown below:

Column 6,
Line 35, please delete “claim 4”, and substitute therefore -- claim 8 --.

Column 7,
Line 19, after “device;”, enter a return and begin a new paragraph with -- two pair … --.

Signed and Sealed this

Third Day of August, 2004

JON W. DUDAS
*Acting Director of the United States Patent and Trademark Office*